US011274385B2

(12) United States Patent
Imaizumi et al.

(10) Patent No.: US 11,274,385 B2
(45) Date of Patent: Mar. 15, 2022

(54) SEWING MACHINE

(71) Applicant: BROTHER KOGYO KABUSHIKI KAISHA, Nagoya (JP)

(72) Inventors: Kazutaka Imaizumi, Nagoya (JP); Ngoc anh huyen Nguyen, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 91 days.

(21) Appl. No.: 16/891,182

(22) Filed: Jun. 3, 2020

(65) Prior Publication Data

US 2020/0291558 A1 Sep. 17, 2020

Related U.S. Application Data

(63) Continuation-in-part of application No. PCT/JP2018/019608, filed on May 22, 2018.

(30) Foreign Application Priority Data

Dec. 15, 2017 (JP) ..... JP2017-240575

(51) Int. Cl.
*D05B 19/12* (2006.01)
*D05B 19/10* (2006.01)

(52) U.S. Cl.
CPC ..... *D05B 19/10* (2013.01); *D05B 19/12* (2013.01)

(58) Field of Classification Search
CPC ..... D05B 19/16; D05B 19/12; D05B 19/10; D05B 79/00
See application file for complete search history.

(56) References Cited

U.S. PATENT DOCUMENTS 5,072,680 A * 12/1991 Nakashima ..... D05B 79/00 112/445
5,195,451 A * 3/1993 Nakashima ..... D05B 21/00 112/102.5

(Continued)

FOREIGN PATENT DOCUMENTS

JP 2009-201621 A 9/2009
JP 2011-194043 A 10/2011

(Continued)

OTHER PUBLICATIONS

Jul. 24, 2018 Search Report issued in International Patent Application No. PCT/JP2018/019608.

*Primary Examiner* — Tajash D Patel
(74) *Attorney, Agent, or Firm* — Oliff PLC

(57) ABSTRACT

A sewing machine includes a bed portion, a conveyance portion, a sewing portion, an image capture portion, a projector, a processor, and a memory. The conveyance portion is configured to convey a sewing object placed on the bed portion. The memory is configured to store marker information and computer-readable instructions that, when executed by the processor, instruct the processor to perform processes. The processes include causing the image capture portion to perform the image capture at a predetermined timing, during a conveyance period, identifying the marker in a captured image, using the marker information stored in the memory, identifying a projection position corresponding to the identified marker, when the marker is identified, and causing the projector to project the projection image indicating the identified projection position, while following a movement of the marker on the sewing object being conveyed.

15 Claims, 11 Drawing Sheets

(56) References Cited

U.S. PATENT DOCUMENTS

| | | | | |
|---|---|---|---|---|
| 6,161,491 | A * | 12/2000 | Takenoya | D05B 19/02 112/102.5 |
| 8,738,168 | B2 * | 5/2014 | Naka | D05B 19/105 700/136 |
| 9,302,404 | B2 * | 4/2016 | Matsushima | B26D 5/005 |
| 9,650,734 | B2 * | 5/2017 | Elliott | D05B 81/00 |
| 11,060,221 | B2 * | 7/2021 | Minematsu | D05B 19/10 |
| 2009/0266282 | A1 | 10/2009 | Suzuki et al. | |
| 2011/0226170 | A1 | 9/2011 | Tokura | |
| 2014/0000498 | A1 | 1/2014 | Yamanashi et al. | |
| 2014/0026794 | A1 | 1/2014 | Imaizumi et al. | |

FOREIGN PATENT DOCUMENTS

| | | | |
|---|---|---|---|
| JP | 2014-8073 | A | 1/2014 |
| JP | 2014-23798 | A | 2/2014 |

* cited by examiner

REAR
LEFT
RIGHT
FRONT
RC
PN
54
R1
R2
R3
R4
RP
60
68
PP
PM
PQ
PJ
VL
VL'
SL
D1
D2

SEWING MACHINE

CROSS-REFERENCE TO RELATED APPLICATION

This application is a continuation-in-part of International Application No. PCT/JP2018/019608 filed on May 22, 2018, which claims priority to Japanese Application JP2017-240575 filed on Dec. 15, 2017, the entire contents of both of which are hereby incorporated by reference.

BACKGROUND

The present disclosure relates to a sewing machine.

A sewing machine is known that can detect, from a captured image of a sewing object captured during sewing, a marker that is placed on the sewing object by a user. The known sewing machine makes changes to a sewing condition, such as stopping sewing or the like, which is identified on the basis of the detected marker, at a position identified on the basis of the marker.

SUMMARY

In the known sewing machine, due to the influence of a feed efficiency of the sewing object, an inclination of a cloth during the sewing, and the like, the position of the marker detected by the sewing machine sometimes differs from an actual position of the marker. In this type of case, the sewing machine cannot make the changes to the sewing condition, such as stopping the sewing or the like, which is identified on the basis of the detected marker, at the position instructed by the marker. In other words, the sewing condition is changed at a position that differs from the position of the marker placed by the user.

Embodiments of the broad principles derived herein provide a sewing machine capable of notifying a user of a position of a marker, on a sewing object, detected by the sewing machine.

Embodiments provide a sewing machine that includes a bed portion, a conveyance portion, a sewing portion, an image capture portion, a projector, a processor, and a memory. The conveyance portion includes a feed dog. The conveyance portion is configured to convey a sewing object placed on the bed portion in a conveyance direction, using the feed dog. The sewing portion includes a needle bar. The sewing portion is configured to form stitches in the sewing object conveyed by the conveyance portion, by causing a sewing needle mounted on the needle bar to move up and down. The image capture portion is configured to perform image capture of an image capture range including below the needle bar. The projector is configured to project a projection image toward the bed portion. The processor is configured to control the conveyance portion, the sewing portion, the image capture portion, and the projector. The memory is configured to store marker information and computer-readable instructions that, when executed by the processor, instruct the processor to perform processes. The processes include causing the image capture portion to perform the image capture at a predetermined timing, during a conveyance period in which the conveyance portion is being driven, identifying the marker in a captured image obtained by the image capture, using the marker information stored in the memory, identifying a projection position corresponding to the identified marker, when the marker is identified, and causing the projector to project the projection image indicating the identified projection position, while following a movement of the marker on the sewing object being conveyed.

BRIEF DESCRIPTION OF THE DRAWINGS

Embodiments will be described below in detail with reference to the accompanying drawings in which.

Figures 6A, 6B, 6C, 6D, 6E, 6F, 6G, 6H:
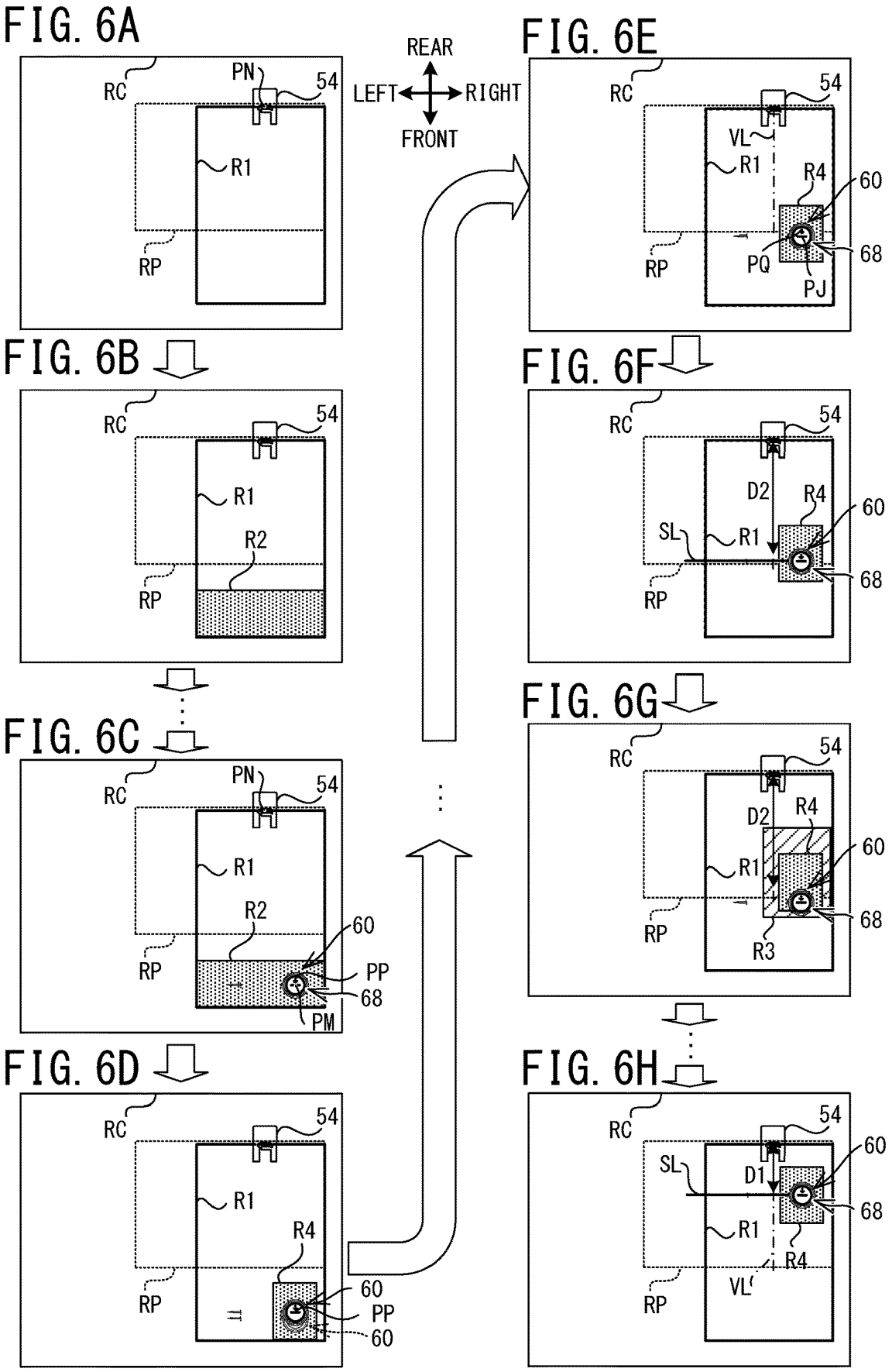

Each of FIG. 6A to FIG. 6H is a plan view schematically showing, with respect to an image capture range of an image sensor and a projection range of a projector, a first range, a second range, a third range, a fourth range, a first distance, a second distance, and a line segment that are set in specific examples; and Each of FIG. 7A to FIG. 7E is a view showing a projection image of a modified example corresponding to FIG. 6H.

DETAILED DESCRIPTION

Hereinafter, an embodiment of the present disclosure will be explained with reference to the drawings. The drawings are used to explain technological features that the present disclosure can utilize, and a configuration of a device that is described, and the like do not limit the present disclosure to only that configuration, and the like, but are merely explanatory examples.

Figure 1:
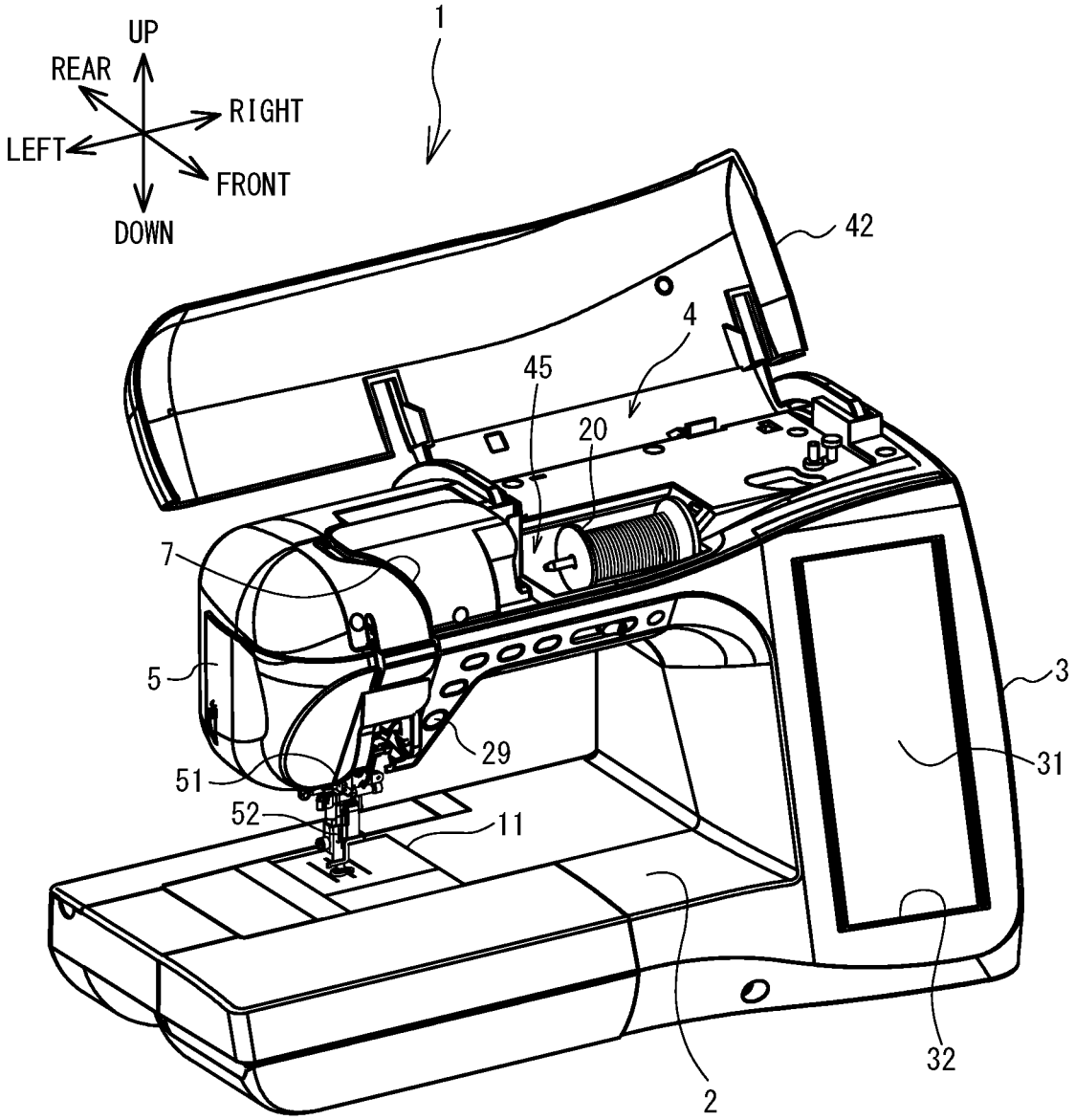
FIG. 1 is a perspective view of a sewing machine.

A physical configuration of a sewing machine 1 will be explained with reference to FIG. 1 to FIG. 3. In the following description, the upper side, the lower side, the lower left side, the upper right side, the lower right side, and the upper left side in FIG. 1 are respectively the upper, the lower, the left, the right, the front and the rear of the sewing machine 1. In other words, a surface on which a liquid crystal display (hereinafter referred to as LCD) 31 to be described later is disposed is a front surface of the sewing machine 1. A longer direction of a bed portion 2 and an arm portion 4 is the left-right direction of the sewing machine 1. A side on which a pillar portion 3 is disposed is the right side of the sewing machine 1. A direction in which the pillar portion 3 extends is the up-down direction of the sewing machine 1.

As shown in FIG. 1, the sewing machine 1 is mainly provided with the bed portion 2, the pillar portion 3, and the arm portion 4. The bed portion 2 is a base portion of the sewing machine 1 and extends in the left-right direction. The pillar portion 3 extends upward from the right end portion of the bed portion 2. The arm portion 4 extends to the left from an upper portion of the pillar portion 3. The left end portion of the arm portion 4 is a head portion 5.

Figure 2:
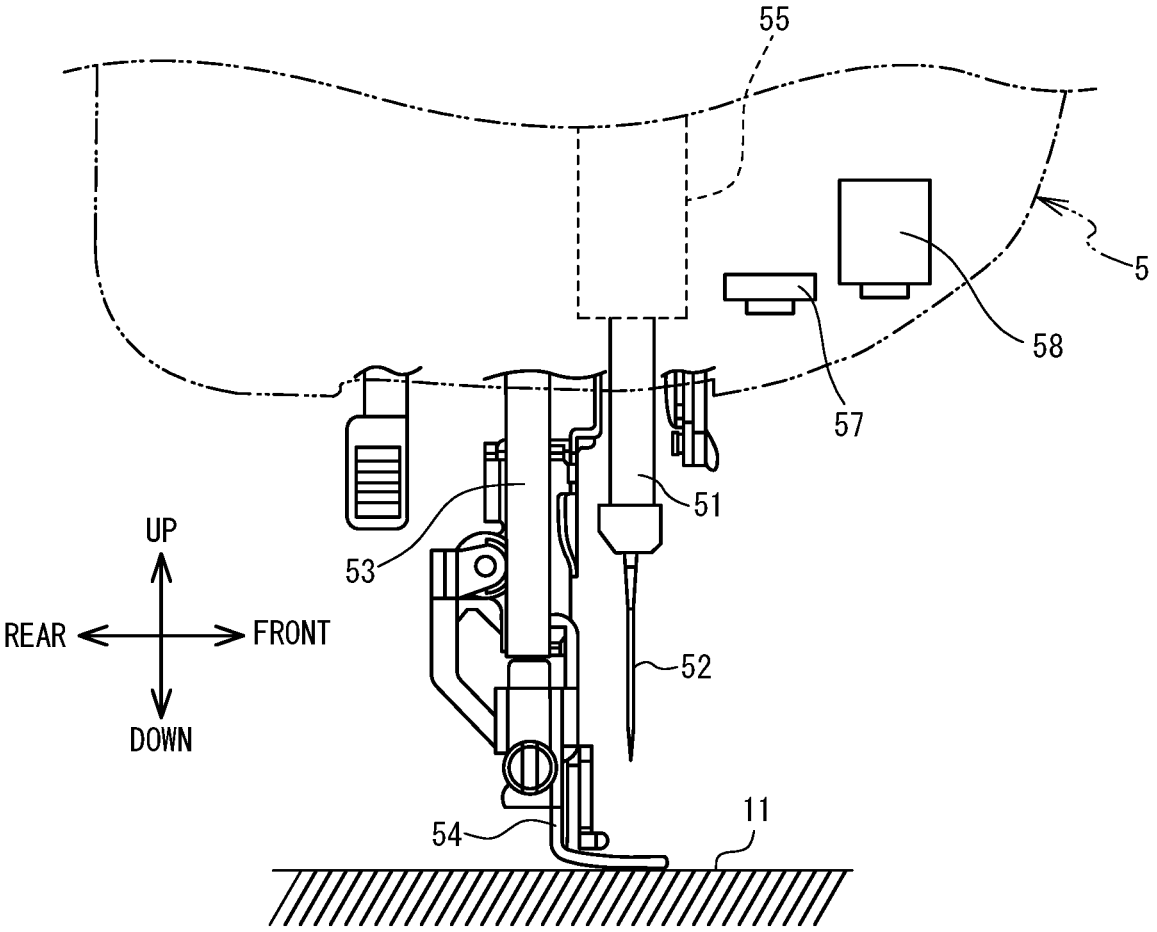
FIG. 2 is a left side view of a lower end portion of a head.

As shown in FIG. 2, a needle plate 11 is provided on an upper surface of the bed portion 2. The needle plate 11 is disposed below a needle bar 51 provided on the head portion 5. The needle plate 11 has a needle hole (not shown in the drawings) through which a sewing needle 52 can be inserted. During sewing, a needle tip of the sewing needle 52 that is mounted on the lower end of the needle bar 51 is inserted through the needle hole in accordance with the up and down movement of the needle bar 51. A sewing object (not shown in the drawings) is placed on the upper surface of the bed portion 2 and the needle plate 11. The sewing object is a work cloth, for example. A position at which the needle tip of the sewing needle 52 pierces the sewing object in accordance with the up and down movement of the needle bar 51 is also referred to as a needle drop position, and a number of times that the needle tip of the sewing needle 52 pierces the sewing object is also referred to as a number of stitches. Inside the bed portion 2, the sewing machine 1 is provided with a lower shaft, a conveyance portion 21 (refer to FIG. 3), a shuttle mechanism, and the like. The lower shaft is driven to rotate in synchronization with a drive shaft 34. The conveyance portion 21 includes a feed dog 24 and a feed mechanism 23, and is configured to convey the sewing object placed on the bed portion 2 in a conveyance direction, using the feed dog 24. The conveyance portion 21 further includes a feed amount adjustment motor 22 (refer to FIG. 3). The feed amount adjustment motor 22 is a pulse motor, and is configured to adjust a feed amount and a feed direction of the sewing object conveyed by the conveyance portion 21. The feed mechanism 23 is configured to move feed dog 24 in an orbital path while keeping the upper surface of the feed dog 24 substantially parallel with the upper surface of the needle plate 11 in synchronization with the rotation of the drive shaft 34. During normal straight line sewing, the conveyance direction is to the rear, and an upstream side and a downstream side in the conveyance direction are, respectively, the front side and the rear side. The shuttle mechanism is a known mechanism that is driven in accordance with the rotation of the lower shaft. The shuttle mechanism forms stitches in the sewing object in concert with the sewing needle 52 mounted on the lower end of the needle bar 51.

Figure 3:
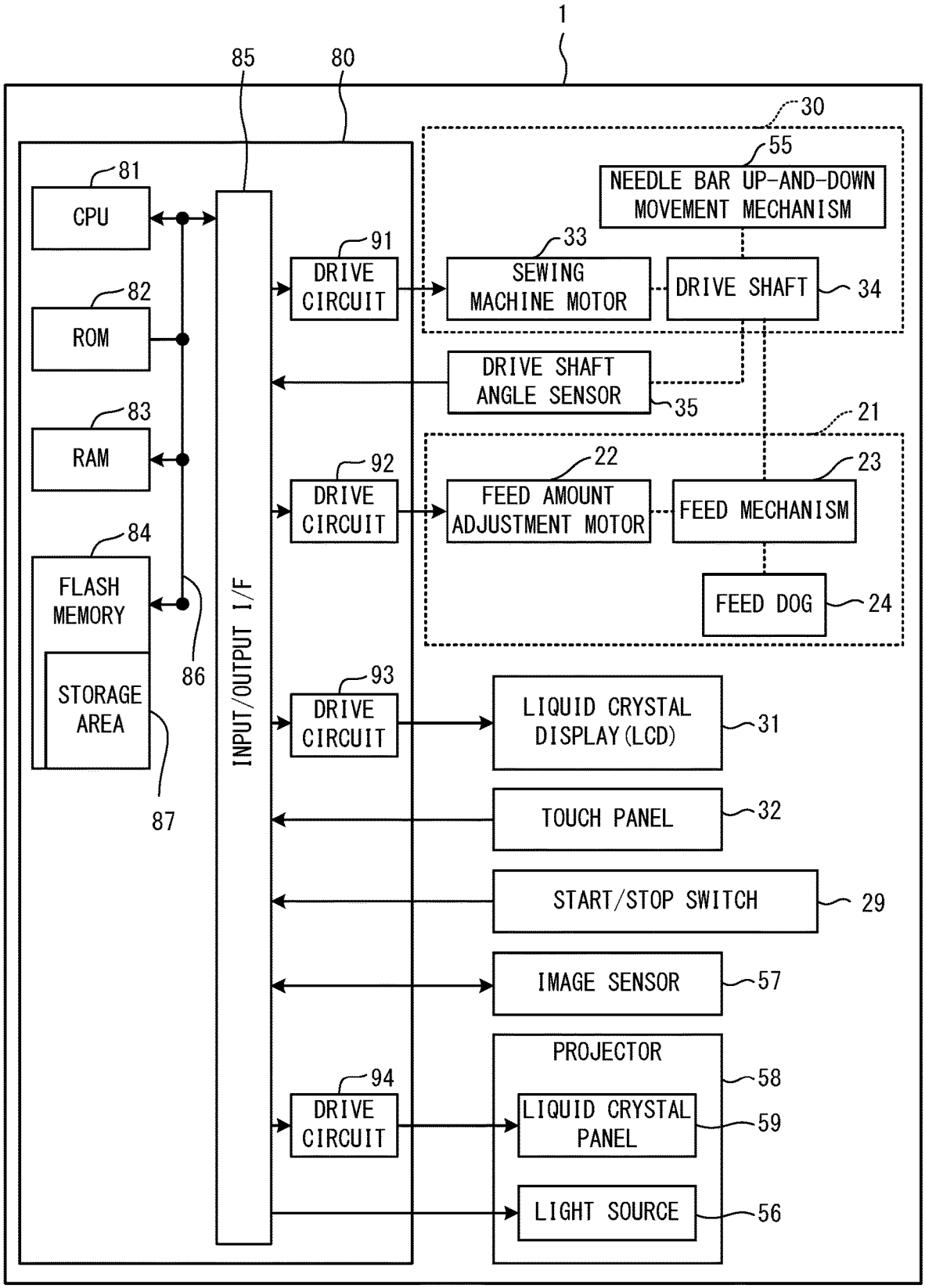
FIG. 3 is a block diagram showing an electrical configuration of the sewing machine.

The pillar portion 3 is provided internally with a processor 80 (refer to FIG. 3) of the sewing machine 1 and a sewing machine motor 33 (refer to FIG. 3). The sewing machine motor 33 is driven to rotate by the drive shaft 34 provided inside the arm portion 4. The drive shaft 34 and the lower shaft are coupled by a timing belt (not shown in the drawings). The LCD 31 and a touch panel 32 are provided in the front surface of the pillar portion 3. An image including various items, such as commands, illustrations, setting values, messages, and the like is displayed on the LCD 31. The touch panel 32 is provided on the front surface side of the LCD 31, and can detect a position that is approached, touched, or depressed. The touch panel 32 receives input of operations using a finger, a dedicated touch pen, or the like. A CPU 81 (refer to FIG. 3) of the sewing machine 1 is configured to detect a selected item on the image, on the basis of the detected position. Hereinafter, an operation by a user on the touch panel 32 is referred to as a panel operation. By the user performing the panel operation, a pattern to be sewn, a command to be executed, and the like can be selected.

A cover 42 that can open and close is provided on an upper portion of the arm portion 4. A thread housing portion 45 is provided below the cover 42. A thread spool 20, around which an upper thread is wound, is housed in the thread housing portion 45. During sewing, the upper thread wound around the thread spool 20 is supplied from the thread spool 20 to the sewing needle 52 mounted on the needle bar 51, via a predetermined path provided in the head portion 5. The drive shaft 34, which extends in the left-right direction, is provided inside the arm portion 4. The drive shaft 34 is driven to rotate by the sewing machine motor 33. Various switches, including a start/stop switch 29, are provided on a lower portion on the left of the front surface of the arm portion 4. The start/stop switch 29 starts or stops operation of the sewing machine 1. In other words, the start/stop switch 29 is used to input a command to start sewing or stop the sewing.

As shown in FIG. 2, on the head portion 5, the sewing machine 1 is provided with the needle bar 51, a presser bar 53, a needle bar up-and-down movement mechanism 55, an image sensor 57, and a projector 58. The sewing needle 52 is detachably mounted on the lower end of the needle bar 51. A presser foot 54 is detachably mounted on the lower end portion of the presser bar 53. The needle bar up-and-down movement mechanism 55 is configured to drive the needle bar 51 in the up-down direction using the rotation of the drive shaft 34. A sewing portion 30 includes the needle bar 51 and is configured to form the stitches by causing the sewing needle 52 mounted on the needle bar 51 to move up and down with respect to the sewing object conveyed by the conveyance portion 21.

The image sensor 57 is, for example, a known area sensor in which a plurality of imaging elements aligned in a main scanning direction are arranged in a plurality of rows in a sub-scanning direction. A known complementary metal oxide semiconductor (CMOS) is used as the imaging element, for example. In the present embodiment, the main scanning direction and the sub-scanning direction respectively correspond to the left-right direction and the front-rear direction of the sewing machine 1. The image sensor 57 is configured to capture an image of an image capture range RC (refer to FIG. 6) that includes a position (the needle drop position) below the needle bar 51.

The projector 58 is configured to project an image onto a predetermined range (a projection range RP (refer to FIG. 6)) on the bed portion 2. The projector 58 is provided with a cylindrical housing, and with a liquid crystal panel 59, a light source 56 (refer to FIG. 3), and an imaging lens (not shown in the drawings) that are housed inside the housing. The housing is fixed to a machine casing inside the head portion 5. The light source 56 is an LED. The liquid crystal panel 59 modulates light from the light source 56, and forms image light of a projection image on the basis of image data representing the projection image. The imaging lens focuses the image light formed by the liquid crystal panel 59 on the projection range RP on the bed portion 2. The projector 58 of a present embodiment projects the projection image from diagonally above the sewing object on the bed portion 2, and thus, processing is performed on the projection image to correct distortion of the image. The projection range RP of the projector 58 of the present embodiment is adjusted so as to be a smaller range than an image capture range RC of the image sensor 57, and a size of the projection range RP (a number of dots of a long side and a short side of a rectangular range, for example) is stored in advance in a flash memory 84.

An electrical configuration of the sewing machine 1 will be explained with reference to FIG. 3. The sewing machine 1 is provided with the processor 80. The processor 80 is provided with the CPU 81, a ROM 82, a RAM 83, the flash memory 84, an input/output interface (I/F) 85, and drive circuits 91 to 94. The CPU 81 is connected to the ROM 82, the RAM 83, the flash memory 84 and the input/output I/F 85 via a bus 86. The input/output I/F 85 is electrically connected to the drive circuits 91 to 94.

The CPU 81 performs main control of the sewing machine 1, and executes various arithmetic operations and processing relating to sewing, image capture, and image projection, in accordance with various programs stored in the ROM 82. Although not shown in the drawings, the ROM 82 is provided with a plurality of storage areas including a program storage area. The various programs used to operate the sewing machine 1 are stored in the program storage area. For example, a program of main processing and the like to be described later is stored in the program storage area. Calculation results of the arithmetic processing performed by the CPU 81 can be stored in the RAM 83. The flash memory 84 includes a storage area 87 that stores marker information. The marker information will be described later. The flash memory 84 stores various parameters used by the sewing machine 1 to perform various types of processing. For example, the parameters include variables that cause a world coordinate system, an image coordinate system of the image sensor 57, and a projection coordinate system of the projector 58 to be associated with each other. The world coordinate system indicates whole space, and is a coordinate system that is not influenced by a center of gravity or the like.

The drive circuit 91 is connected to the sewing machine motor 33, and is configured to drive the sewing machine motor 33 in accordance with a control signal from the CPU 81. The drive circuit 92 is connected to the feed amount adjustment motor 22, and is configured to drive the feed amount adjustment motor 22 in accordance with a control signal from the CPU 81. The drive circuit 93 is configured to drive the LCD 31 in accordance with a control signal from the CPU 81, and causes an image, an operation screen, and the like to be displayed on the LCD 31. The drive circuit 94 is configured to drive the liquid crystal panel 59 of the projector 58 in accordance with a control signal from the CPU 81, and causes the projection image to be displayed on the liquid crystal panel 59.

The light source 56 of the projector 58, a drive shaft angle sensor 35, the touch panel 32, the start/stop switch 29, and the image sensor 57 are further connected to the input/output I/F 85. The light source 56 illuminates in accordance with a control signal from the CPU 81, and projects the projection image displayed on the liquid crystal panel 59 onto the sewing object being conveyed on the bed portion 2. The drive shaft angle sensor 35 can detect a rotation speed, and a rotation position of the sewing machine motor 33. The touch panel 32 can output, to the CPU 81, coordinate data indicating an input position of the operation using the finger or the dedicated touch pen. On the basis of the coordinate data acquired from the touch panel 32, the CPU 81 is configured to detect the item selected on the operation screen displayed on the LCD 31, and performs corresponding processing. The start/stop switch 29 can receive an input of an operation relating to the sewing machine 1 separately from the touch panel 32, and can perform output to the CPU 81. When the CPU 81 receives the input of the operation relating to the start/stop switch 29, the CPU 81 outputs a control signal to start or to stop a sewing operation. The image sensor 57 can output, to the CPU 81, data of a captured image captured by the imaging elements.

Figure 4:
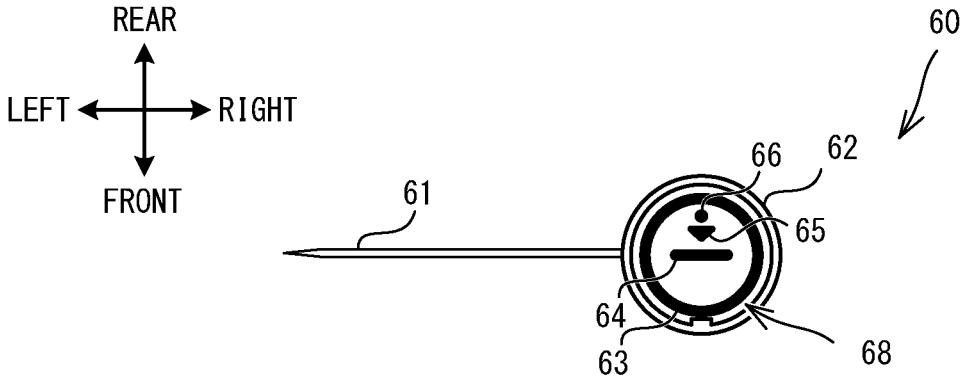
FIG. 4 is a plan view of a marking pin on which a marker is printed.

A marker 68 will be explained with reference to FIG. 4. The upper side, the lower side, the left side, and the right side in FIG. 4 are respectively explained as the rear side, the front side, the left side, and the right side of the marker 68. As shown in FIG. 4, the marker 68 of the present embodiment is provided on a marking pin 60. The marking pin 60 includes a needle portion 61 and a head portion 62. The head portion 62 is a white, circular thin plate shape. The head portion 62 is fixed to the right end portion of the needle portion 61, at a position at which an axial line of the needle portion 61 is disposed on a line passing through a center, in the front-rear direction, of the head portion 62. The marker 68 includes black graphics 63 to 66 that are drawn on the upper surface of the head portion 62. The graphic 63 is a circular shape drawn on the inside of an outer periphery of the head portion 62, of the upper surface of the head portion 62. A center of the graphic 63 is aligned with a center of the outer periphery of the head portion 62. The graphic 64 is a line segment shape extending in the left-right direction that is drawn on the inside of the graphic 63. The graphic 64 extends along the axial line of the needle portion 61. The graphic 65 is an upside-down triangular shape drawn on the rear side of the graphic 64. The graphic 66 is a circular shape drawn on the rear side of the graphic 65. A center of the head portion 62 and centers of each of the graphics 63 to 66 in the left-right direction are on the same straight line extending in the front-rear direction. Each of the graphics 63 to 66 are separated from each other. By fixing the marking pin 60 to the sewing object, a user can instruct, to the sewing machine 1, a type of sewing condition, and a change position at which the sewing condition changes. The type of the sewing condition of the present embodiment is a sewing stop position, for example. The change position of the sewing condition of the present embodiment is an intersection between a virtual line VL (refer to FIG. 6) that extends from the needle bar 51 toward the front, and a line segment extending in the left-right direction through a position of the marker 68. The sewing machine 1 of the present embodiment detects a center in the lengthwise direction of the graphic 64 as the position of the marker 68.

Main processing of the present embodiment will be explained with reference to FIG. 5 and FIG. 6. In the main processing, when performing straight line sewing, processing to stop the sewing is performed on the basis of the position, in the conveyance direction, of the marker 68 on the sewing object. In advance of the sewing, the user fixes the marking pin 60, on which the marker 68 is provided, to the sewing object. When the processor 80 of the present embodiment acquires a command to start the sewing via the start/stop switch 29, the processor 80 reads out, to the RAM 83, the program to perform the main processing stored in the program storage area in the ROM 82. The CPU 81 performs the following steps in accordance with commands included in the program read out to the RAM 83. Various parameters necessary to perform the main processing (a first distance D1, and a second distance D2, for example) are stored in the flash memory 84. Various data obtained in the course of the main processing are stored as necessary in the RAM 83. In the present embodiment, using known technology, a thickness of the sewing object is detected in advance, and the detected thickness is used to calculate coordinates in each of image systems. A method for acquiring the thickness of the sewing object and a method for calculating the coordinates in each of the image systems may be changed as appropriate (Japanese Laid-Open Patent Publication No. 2011-194043 discloses a method for detecting a thickness of a sewing object, which is incorporated herein by reference).

Figure 5:
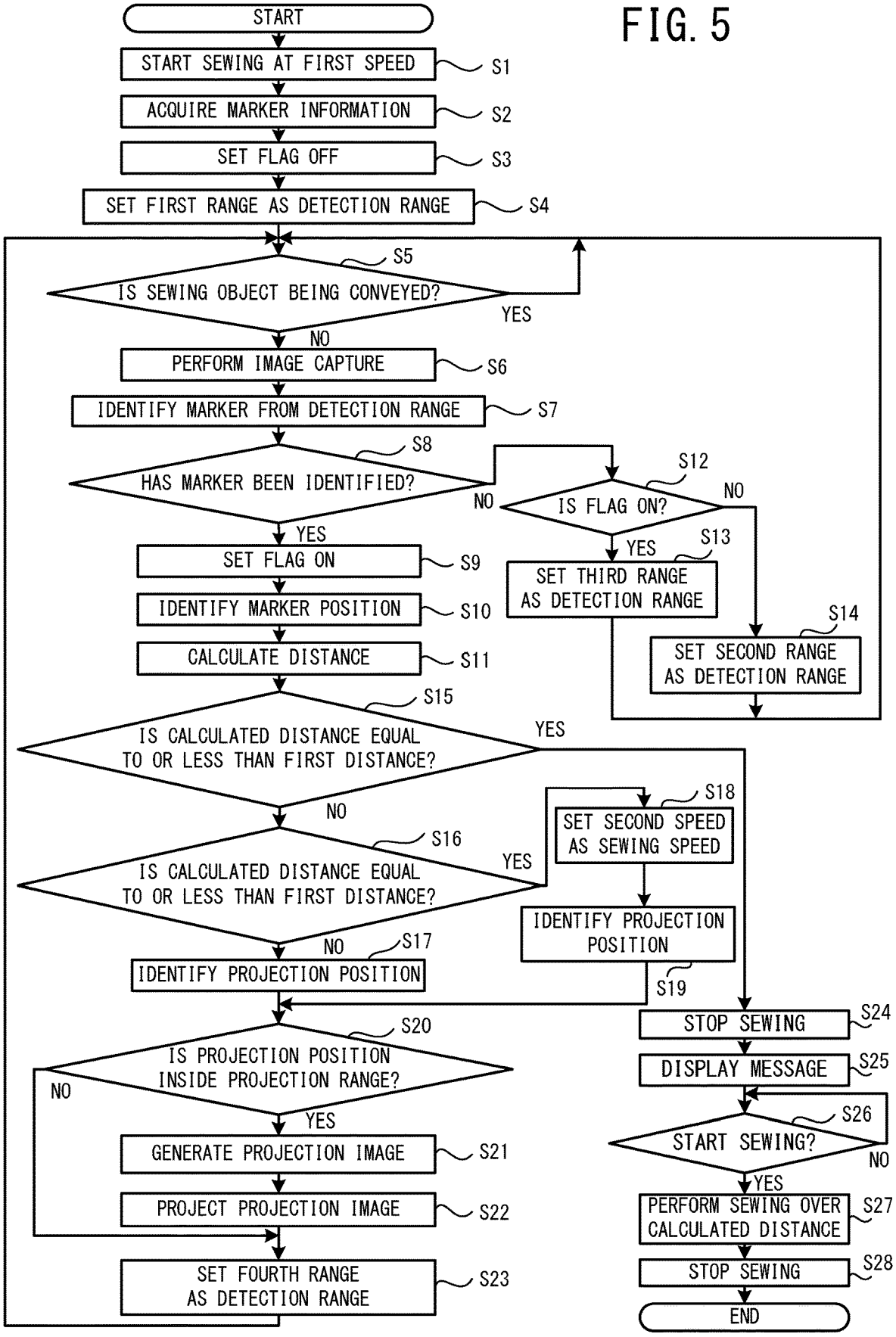
FIG. 5 is a flowchart of main processing.

As shown in FIG. 5, the processor 80 controls the drive circuit 91 and the drive circuit 92, and starts the sewing with a first speed as a sewing speed (step S1). The sewing speed is a length of stitches sewn per unit of time, and, when performing the straight line sewing, is the same definition as a conveyance speed (a product of a number of stitches per unit of time and a feed amount). The processor 80 of the present embodiment causes the sewing speed to be the first speed by controlling a number of steps to the sewing machine motor 33. The first speed may be a speed that is set in advance and stored in the flash memory 84, or may be a speed that is input by the user before the start of sewing, via the touch panel 32. The processor 80 refers to the storage area 87 of the flash memory 84, and acquires the marker information to be described later (step S2). The processor 80 sets a flag to OFF (step S3). The flag is information indicating whether or not, after the main processing is started, the marker 68 has been identified from the captured image. The flag is ON when the marker 68 has been identified, and is OFF when the marker 68 has not been identified. The processor 80 sets a first range R1 as a detection range (step S4). The processor 80 of the present embodiment sets a part of the captured image obtained by the image capture as the detection range, and identifies the marker 68 in the detection range using the marker information stored in the flash memory 84 and acquired at step S2. The processor 80 sets the first range R1 that is the part of the captured image, as the detection range at the start of the sewing (step S4). As shown in FIG. 6A, the first range R1 of the present embodiment is a rectangular range that is long in the front-rear direction and extends to the front from a position below the needle bar 51 (a needle drop position PN), in a region that forms a right half of the image capture range RC.

The processor 80 determines whether the sewing object is being conveyed (step S5). The sewing object is being conveyed when the feed dog 24 is higher than the needle plate 11. More specifically, the sewing object is being conveyed when the leading end of the sewing needle 52 is higher than the needle plate 11. On the basis of an output signal of the drive shaft angle sensor 35, when an angle of the drive shaft 34 is in a predetermined range, the processor 80 of the present embodiment determines that the sewing object is being conveyed. When the sewing object is being conveyed (yes at step S5), the processor 80 returns the processing to step S5. When the sewing object is not being conveyed (no at step S5), the processor 80 controls the image sensor 57, causes the image capture range RC to be captured, and acquires the captured image (step S6). By the processing at step S5 and step S6, the image of the sewing object is captured by the image sensor 57 when the sewing object is not being conveyed during a conveyance period in which the conveyance portion 21 is being driven. The conveyance period includes a first period and a second period. The first period is a period in which the upper end of the feed dog 24 is located above the upper end of the needle plate 11 and the feed dog 24 moves from the front to the rear. The second period is a period in which the upper end of the feed dog 24 is located below the upper end of the needle plate 11. The feed dog 24 moves from the rear to the front during the second period. The processor 80 causes the image sensor 57 to capture the image of the sewing object at an image capture timing that is when the sewing object is not being conveyed during the conveyance period. In other words, the processor 80 causes the image sensor 57 to capture the image of the sewing object at the image capture timing during the second period from among the conveyance period.

The processor 80 uses the marker information acquired by the processing at step S2 and identifies the marker 68 from inside the detection range in the captured image (step S7). A known method may be used as appropriate as a method for identifying the marker 68. In the present embodiment, the sewing machine 1 stores a procedure for identifying the marker 68, as the marker information. The processor 80 identifies the marker 68 in accordance with the procedure indicated by the marker information. More specifically, the processor 80 identifies the marker 68 from inside the detection range using the following procedure, for example. For example, by performing Hough transformation processing, which is known technology, on the image of the detection range, the processor 80 extracts a circumferential line (the graphic 63), and sequentially extracts the graphics 64 to 66 that are inside the extracted circumferential line. The processor 80 identifies the marker 68 on the basis of relative positions of the graphics 63 to 66.

The processor 80 determines whether the marker 68 has been identified from the captured image by the processing at step S7 (step S8). When the marker 68 has not been identified (no at step S8), the processor 80 determines whether the flag is set to ON (step S12). When the flag is not set to ON (no at step S12), the processor 80 sets a second range R2 as the detection range (step S14). As shown by shading in FIG. 6B, the second range R2 is a rectangular range that is long in the left-right direction and that is disposed on the front end portion of the first range R1. The second range R2 of the present embodiment is outside the projection range RP of the projector 58. The second range R2 in the captured image is stored in advance in the flash memory 84. The processor 80 returns the processing to step S5.

At step S6 that is repeatedly performed, when the image capture range RC shown in FIG. 6C is captured, the processor 80 identifies the marker 68 (step S7) from the detection range (the second range R2), and determines that the marker 68 has been identified (yes at step S8). In this case, the processor 80 sets the flag to ON (step S9). The processor 80 identifies a marker position, which is a position of the marker 68 identified by the processing at step S7 (step S10). In the image coordinate system, the processor 80 identifies coordinates of a midpoint in the lengthwise direction of the graphic 64, and, using the variable stored in the flash memory 84, converts the identified coordinates to coordinates of the world coordinate system. The processor 80 sets the converted coordinates of the world coordinate system as a marker position PM.

The processor 80 calculates a distance between the marker position PM calculated at step S10 and the needle drop position PN (step S11). The coordinates of the world coordinate system of the needle drop position PN are stored in advance in the flash memory 84. At step S11, the processor 80 of the present embodiment calculates the distance between the marker position PM and the needle drop position PN in the conveyance direction. In the present embodiment, the processor 80 determines whether the distance calculated at step S11 is equal to or less than the first distance D1 (step S15). The first distance D1 is a distance that is set in advance taking into account performing an operation by which the user removes the marking pin 60 from the sewing object. When the calculated distance is not equal to or less than the first distance D1 (no at step S15), the processor 80 determines whether the distance calculated at step S11 is equal to or less than the second distance D2 (step S16). The second distance D2 is longer than the first distance D1, and is shorter than a distance from the needle drop position PN to the front end of the second range R2 and a distance from the needle drop position PN to the front end of the projection range RP. In other words, a distance between the marker position PM identified from the second range R2 and the needle drop position PN is longer than the second distance D2.

When the distance calculated at step S11 is not equal to or less than the second distance D2 (no at step S16), the processor 80 identifies a projection position corresponding to the identified marker 68 (step S17). The processor 80 identifies the projection position on a predetermined plane corresponding to the identified marker 68. The predetermined plane is an X-Y plane of the world coordinate system and a Z coordinate of the predetermined plane has a predetermined value. The predetermined value of the present embodiment is a value corresponding to the thickness of the sewing object, for example. In other words, the predetermined plane of the present embodiment corresponds to the upper surface of the sewing object. The predetermined plane may correspond to the upper surface of the needle plate 11. The processor 80 identifies, as the projection position, a position closer to the needle bar 51 by a predetermined amount than the marker position that is the position on the sewing object of the marker 68 identified by the processing at step S7. More specifically, the faster the set sewing speed, the larger the predetermined amount is set to be, in comparison to when the sewing speed is slower, and the processor 80 identifies the projection position as the position that is closer to the needle bar 51, by the set predetermined amount, than the marker position. A relationship between the sewing speed and the predetermined amount is stored in advance in the flash memory 84. Identifying the projection position by the processing in this way is performed in order to take into account the conveyance amount of the sewing object in a period from the image capture to when the projection image is projected. With respect to the relationship between the sewing speed and the predetermined amount, when the sewing speed is the first speed, the predetermined amount is a first amount, and when the sewing speed is a second speed, the predetermined amount is a second amount, for example. The first amount is, for example, a distance between the graphic 64 and the graphic 66 in the front-rear direction. For the marker position PM shown in FIG. 6C, a projection position PP is identified that is closer to the needle drop position, by the first amount, from the marker position PM.

The processor 80 determines whether the projection position PP identified by the processing at step S17 is inside the projection range RP (step S20). The projection position PP shown in FIG. 6C is not inside the projection range RP (no at step S20). In this case, the processor 80 sets a fourth range R4 as the detection range (step S23). As shown in FIG. 6D, the fourth range R4 includes the projection position PP identified by the processing at step S17, and is smaller than the first range R1 set by the processing at step S4. In FIG. 6D, the position of the marking pin 60 at the time of the processing performed at step S6 (the time of the image capture) is indicated by a dotted line, and the position of the marking pin 60 at the time of the processing performed at step S23 is indicated by a solid line. The fourth range R4 of the present embodiment is smaller than the second range R2 set by the processing at step S14. The fourth range R4 is a rectangular shape that is long in the front-rear direction and that is included in the first range R1. The fourth range R4 is a rectangular shape that is longer to the rear than to the front when the marker position PM identified by the processing at step S10 is taken as a point of reference (for example, as a center of the fourth range R4). The processor 80 returns the processing to step S5.

At step S6 that is repeatedly performed, when the image capture range RC shown in FIG. 6E is captured, a marker position PJ is identified from the fourth range R4 (step S10). In this case, it is determined that the distance calculated at step S11 is not equal to or less than the first distance D1 (no at step S15), and is also not equal to or less than the second distance D2 (no at step S16). The processor 80 identifies a projection position PQ using the marker position PJ and the predetermined amount (step S17), and it is determined that the projection position PQ is inside the projection range RP (yes at step S20). In this case, the processor 80 generates image data to project the projection image (step S21). In the projection position on the sewing object, the projection image extends in a direction orthogonal to the conveyance direction (in other words, in the left-right direction). The projection image of the present embodiment includes a line segment SL. The processor 80 projects the line segment SL of the projection image projected onto the sewing object apart from onto the marker 68, onto a virtual line VL that extends to the upstream side, in the conveyance direction, from the needle drop position PN that is below the needle bar 51 on the sewing object. The virtual line VL indicates a planned position (a base line) on which stitches are to be formed when the sewing object is conveyed in the conveyance direction. The processor 80 causes the position of the line segment SL in the front-rear direction to be aligned with the position of the projection position PQ in the front-rear direction. The processor 80 sets a position that is to the left from the projection position PQ by a radius of the head portion 62 of the marking pin 60 as the right end of the line segment SL, and sets a position that is a predetermined distance from the right end of the line segment SL as the left end of the line segment SL. The processor 80 generates image data to project the projection image including the line segment SL that intersects the virtual line VL. The processor 80 controls the drive circuit 94 and the light source 56 in accordance with the image data generated at step S21, and projects the projection image indicating the projection position identified by the processing at step S17 (step S22). As shown in FIG. 6F, the processor 80 projects the projection image including the line segment SL, for example. At a time point at which the processing at step S22 is performed, the sewing object is conveyed from a position at the time of image capture shown in FIG. 6E to a position shown in FIG. 6F, by an amount corresponding to a time interval from the time of image capture to the time of projection, and to the conveyance speed. As described above, the processor 80 identifies, as the projection position, a position that is closer to the needle bar 51 than the marker position by the predetermined amount corresponding to the set sewing speed. Thus, at the time of projection, the position of the line segment SL in the conveyance direction is substantially aligned with the position of the graphic 64 in the conveyance direction. After setting the fourth range R4 as the detection range, the processor 80 returns the processing to step S5.

At step S6 that is repeatedly performed, when the image capture range RC shown in FIG. 6G is captured, since the whole of the marker 68 is not included in the fourth range R4 of the acquired captured image, the marker 68 is not identified (step S7, no at step S8). In this case, the processor 80 determines that the flag is ON (yes at step S12), and sets a third range R3 as the detection range (step S13). Processing at step S13 is processing in which, after the marker 68 has been identified on the basis of the detection range in the single captured image, when the marker 68 cannot be identified from the detection range in the captured image captured by the subsequent image capture, the third range R3 is set as the detection range. The third range R3 includes the marker position identified on the basis of the previous captured image in an image capture order, and a range further to the upstream side in the conveyance direction than the detection range identified on the basis of the subsequent captured image. The third range R3 is a rectangular region that is long in the front-rear direction, and that is larger than the fourth range R4, and smaller than the first range R1. The fourth range R4 is encompassed by the third range R3. The third range R3 is encompassed by the first range R1. The processor 80 returns the processing to step S5.

At step S15 and step S16 that are repeatedly performed, when the distance calculated at step S11 is not equal to or less than the first distance D1 (no at step S15), and when the calculated distance is equal to or less than the second distance D2 (yes at step S16), the processor 80 sets, as the sewing speed, the second speed that is slower than the first speed (step S18). The processor 80 controls the drive circuit 91, and performs the sewing at the speed set at step S18. The processor 80 sets the second amount, which is the predetermined amount smaller than the predetermined amount set by the processing at step S17, and identifies the projection position that is closer to the needle bar 51 than the marker position by the set predetermined amount (step S19). The processor 80 performs the processing at step S20 described above.

At step S6 that is repeatedly performed, when the image capture range RC shown in FIG. 6H is captured, in the processing at step S15, the distance calculated at step S11 is determined to be equal to or less than the first distance D1 (yes at step S15). In this case, the processor 80 controls the drive circuit 91 and stops the sewing (step S24). The processor 80 controls the drive circuit 93 and causes a message to be displayed on the LCD 31 (step S25). The message is, for example, "After removing the marking pin, please input re-start command." The user refers to the LCD 31, and after removing the marking pin 60 from the sewing object, inputs the command to start the sewing using the start/stop switch 29. The processor 80 determines whether the command to start the sewing has been acquired (step S26). When the command to start the sewing has not been acquired (no at step S26), the processor 80 returns the processing to step S26. When the command to start the sewing has been acquired (yes at step S26), the processor 80 controls the drive circuit 91, performs the sewing over the distance calculated at step S11 (step S27), and stops the sewing (step S28). The processor 80 calculates a distance sewn on the basis of the feed amount and the number of stitches after re-starting the sewing, for example, and stops the sewing at a time point at which the calculated distance is equal to or greater than the distance calculated at step S11. The processor 80 ends the main processing.

The sewing machine 1 of the above-described embodiment can project the projection image indicating the projection position corresponding to the marker 68 detected on the basis of the captured image, while following a movement of the marker 68 on the sewing object. Using the projection image, the sewing machine 1 can notify the user of a recognition result, by the sewing machine 1, of the position of the marker 68 on the sewing object. The user can ascertain the relationship between the position of the actual marker 68 and the position of the marker 68 detected by the sewing machine 1, by referring to the projection image during sewing.

The processor 80 causes the image sensor 57 to perform the image capture a plurality of times during the conveyance period, and identifies the projection position on the basis of the captured image every time the image capture is performed. More specifically, during the conveyance period, each time the leading end of the sewing needle 52, which is caused to reciprocate up and down by the rotation of the drive shaft 34, is lower than the needle plate 11, the processor 80 causes the image sensor 57 to capture an image of the sewing object. In other words, during the conveyance period, the processor 80 causes the image sensor 57 to perform the image capture a plurality of times at mutually different timings. By projecting the projection image indicating the identified projection position, the processor 80 causes the projector 58 to project the projection image while following the movement of the marker 68 on the sewing object. In comparison to a case in which the projection image is projected on the basis of the marker 68 detected on the basis of the captured image captured by the single image capture, the sewing machine 1 can accurately identify the projection position while taking into account an influence of a feed efficiency of the sewing object and an inclination or the like of the sewing object with respect to the upper surface of the bed portion 2 during the sewing.

The processor 80 identifies, as the projection position, the position closer to the needle bar 51, by the predetermined amount, than the marker position that is the position on the sewing object of the marker 68 identified on the basis of the captured image (step S17, step S19). The sewing machine 1 can identify the projection position while taking into account the fact that the sewing object is being conveyed, during the period from when the captured image is generated to when the projection image is projected on the basis of the captured image.

The processor 80 sets the predetermined amount to be larger the faster the acquired sewing speed, in comparison to when the sewing speed is slower, and the processor 80 identifies, as the projection position, the position that is closer to the needle bar 51 (further to the rear) than the marker position by the set predetermined amount (step S17, step S19). Thus, the sewing machine 1 can identify the projection position while taking into account the fact that the sewing object is being conveyed by the amount corresponding to the sewing speed, during the period from when the captured image is generated to when the projection image is projected on the basis of the captured image.

The processor 80 causes the image sensor 57 to perform the image capture while the sewing object is not being conveyed, during the conveyance period (no at step S5; step S6). Thus, the sewing machine 1 can acquire the clear captured image, in comparison to a case in which the image capture is performed during a period in which the sewing object is being conveyed.

When the marker 68 is identified from the captured image, the processor 80 calculates the distance in the conveyance direction from the marker position to the position below the needle bar 51 (the needle drop position) (step S11), and when the sewing object has been conveyed by the calculated distance from the marker position (step S27), the sewing by the conveyance portion 21 and the sewing portion 30 is stopped (step S28). The sewing machine 1 can stop the sewing on the basis of the detection result of the marker 68. During sewing, by referring to the projection image, the user can verify, before the sewing is stopped, whether or not the sewing is to be stopped at a position instructed by the marker 68, using the relationship between the position of the actual marker 68 and the position of the marker 68 detected by the sewing machine 1. Thus, in comparison to related art, the sewing machine 1 can reduce a possibility that the sewing machine 1 stops the sewing at a position not instructed by the user using the marker 68.

When the distance calculated by the processing at step S11 becomes the first distance D1 (yes at step S15), the processor 80 stops the sewing by the conveyance portion 21 and the sewing portion 30 (step S24). By stopping the sewing, the sewing machine 1 can prompt the user to remove the marker 68 on the sewing object. The sewing machine 1 can suppress defects arising from a case in which the sewing is continued with the marker 68 still in place on the sewing object.

When the distance calculated by the processing at step S11 becomes the second distance D2 that is longer than the first distance D1, the processor 80 causes the conveyance speed of the sewing object by the conveyance portion 21 to be slower than the current speed (step S18). Thus, between the first distance D1 and the second distance D2, by reducing the conveyance speed, the sewing machine 1 can more accurately calculate the first distance D1. In comparison to a case in which the conveyance speed is not reduced, between the first distance D1 and the second distance D2, the user can more easily ascertain the relationship between the position of the actual marker 68 and the position of the marker 68 detected by the sewing machine 1. The sewing machine 1 can shorten a sewing time in comparison to a case in which the sewing object is conveyed at the reduced speed from the start of the sewing.

In the projection position on the sewing object, the processor 80 projects, as the projection image, the line segment extending in the direction orthogonal to the conveyance direction (step S22). Thus, the sewing machine 1 can perform notification of the marker position detected by the sewing machine 1, using the line segment SL that extends in the direction orthogonal to the conveyance direction.

The processor 80 projects the line segment SL as the projection image onto the virtual line VL that extends to the upstream side in the conveyance direction from the needle drop position PN that is below the needle bar 51 on the sewing object (step S22). Thus, when the stitches are formed in the straight line on the sewing object, the stitches are formed along the virtual line VL that extends to the upstream side in the conveyance direction from the needle drop position PN that is below the needle bar 51. The sewing machine 1 can project the line segment SL including the sewing stop position detected by the sewing machine 1 on the basis of the marker 68. Using the projected line segment SL, the user can verify the sewing stop position before the sewing is stopped.

The processor 80 causes the projection image to be projected onto the sewing object apart from onto the marker 68. Thus, the sewing machine 1 can project the projection image in a position that is not on the marker 68. In comparison to a case in which the projection image is projected onto the marker 68, the user can easily verify the actual position of the marker 68 and the position of the marker 68 detected by the sewing machine 1. In comparison to a case in which the projection image is projected onto the marker 68, the sewing machine 1 easily identifies the marker 68 from the captured image when the image of the marker 68 is captured the plurality of times.

The processor 80 sets part of the captured image as the detection range, and, using the marker 68 stored in the flash memory 84, identifies the marker 68 in the detection range. In comparison to identifying the marker 68 from an entire range of the captured image, the sewing machine 1 can identify the marker 68 from the captured image in a shorter time.

The processor 80 sets, as the detection range at the start of the sewing, the first range R1 that is a part of the captured image (step S4), and when the marker 68 is identified from the detection range of the single captured image (yes at step S8), the processor 80 sets the fourth range R4 as the detection range of the captured image that is subsequently captured (step S23). The fourth range R4 includes the projection position identified from the single captured image, and is smaller than the first range R1. In comparison to a case in which the marker 68 is identified from the first range R1 of the captured image even after the marker 68 has been detected, the sewing machine 1 can efficiently identify the marker 68 from the captured image in the shorter time.

The processor 80 sets, as the detection range at the start of the sewing, the first range R1 that is part of the captured image (step S4), and when the marker 68 cannot be identified from the first range R1 (no at step S8; no at step S12), the processor 80 sets the second range R2 as the detection range (step S14). The second range R2, which is on the upstream side in the conveyance direction of the captured image, is smaller than the first range R1. The sewing machine 1 conveys the sewing object from the upstream side to the downstream side in the conveyance direction. When the marker 68 cannot be identified once after the start of the sewing, it is assumed that the marker 68 is disposed on the upstream side with respect to the detection range in the conveyance direction. In comparison to a case in which the sewing machine 1 continues the processing with the first range R1 set as the detection range as it is, the sewing machine 1 can improve a speed of the processing to identify the marker 68.

After the marker 68 has been identified on the basis of the detection range in the single captured image (yes at step S8; step S10), when the marker 68 cannot be identified from the detection range in the captured image captured by the subsequent image capture (no at step S8; yes at step S12), the processor 80 sets the third range R3 as the detection range (step S13). The third range R3 includes the marker position identified on the basis of the single captured image, and the range further to the upstream side in the conveyance direction than the detection range identified on the basis of the subsequent captured image. Thus, after identifying the marker 68 on the sewing object from the detection range, when the sewing machine 1 cannot identify the marker 68 from the detection range of the captured image by the subsequent image capture, the sewing machine 1 can increase a possibility of identifying the marker 68 from the detection range of the captured image by the further subsequent image capture.

The sewing machine of the present disclosure is not limited to the above described embodiment, and various changes may be made without departing from the spirit and scope of the present disclosure. For example, the following modifications may be added as appropriate.

(A) The configuration of the sewing machine 1 may be changed as appropriate. The sewing machine 1 may be an industrial sewing machine or a multi-needle sewing machine. A type, a mounting position, and the like of each of the image capture portion and the projector maybe changed as appropriate. A positional relationship between the image capture range of the image capture portion and the projection range of the projector may be changed as appropriate. The pattern of the marker may be changed as appropriate. The marker may be disposed on a surface of a seal or the like, or may be a mark (a cross, for example) drawn on the sewing object by the user. A configuration may be adopted in which a plurality of types of marker of different sewing conditions can be detected.

(B) The program including the instructions to cause the main processing shown in FIG. 5, to be executed may be stored in a storage device of the sewing machine 1 until the processor 80 executes the program. Therefore, an acquisition method of the program, an acquisition route, and the device that stores the program may each be changed as appropriate. The program to be executed by the processor 80 may be received from another device via a cable or wireless communication, and may be stored in a storage device, such as a flash memory. Examples of the other device include a PC and a server connected via a network.

(C) The respective steps of the main processing performed by the sewing machine 1 are not limited to the example in which they are performed by the processor 80, and a part or all of the steps may be performed by another electronic device (an ASIC, for example). The configuration of the processor 80 may be changed as appropriate. The respective steps of the main processing may be performed through distributed processing by a plurality of electronic devices (a plurality of CPUs, for example). The respective steps of the main processing can be changed in order, omitted or added, as necessary. An aspect in which an operating system (OS) or the like operating on the sewing machine 1 performs a part or all of the main processing on the basis of a command from the processor 80 is also included in the scope of the present disclosure. For example, the following modifications from (C-1) to (C-5) may be added to the main processing, as appropriate.

(C-1) It is sufficient that the marker information be information that can identify the marker from the captured image. For example, the marker information may be image data of the marker, and the processor 80 may identify the marker from the captured image by comparing the image data of the marker and the captured image.

(C-2) The processing that causes the projector to project the projection image indicating the identified projection position, while following the movement of the marker on the sewing object during the sewing, may be changed as appropriate. After once identifying the marker position from the captured image, without performing the image capture, the processor 80 may identify the projection position while following the movement of the marker on the basis of the identified marker position and the drive amount of the conveyance portion 21 (the product of the feed amount and the number of stitches, for example), and may project the projection image indicating the identified projection position. The processor 80 may repeat, a plurality of times, processing performed by a constant amount in which the marker position is identified from the captured image, and the projection position is identified while following the movement of the marker on the basis of the identified marker position, the drive amount of the conveyance portion 21, and the like. When it is possible to ignore the conveyance amount by the conveyance portion 21 during the period from the image capture by the image capture portion to the projection by the projector, the processor 80 may project the marker position as the projection position. The predetermined amount when calculating the projection position may be a constant that does not depend on the sewing speed, or may be set by the user. The processor 80 may cause the projection image to be projected onto the marker when the image capture is only performed once, or the like, as described above. When the processor 80 causes the image capture portion to perform the image capture the plurality of times, the processor 80 may extract, from the captured image, each of the graphic indicating the projection position in the captured image and the marker, may compare an extraction result of each, and may correct the projection position of the graphic. When the extraction results differ from each other by equal to or greater than a predetermined amount, the processor 80 may reduce the sewing speed, or may perform an error notification using the display portion, a voice output portion, or the like.

Figure 7A:
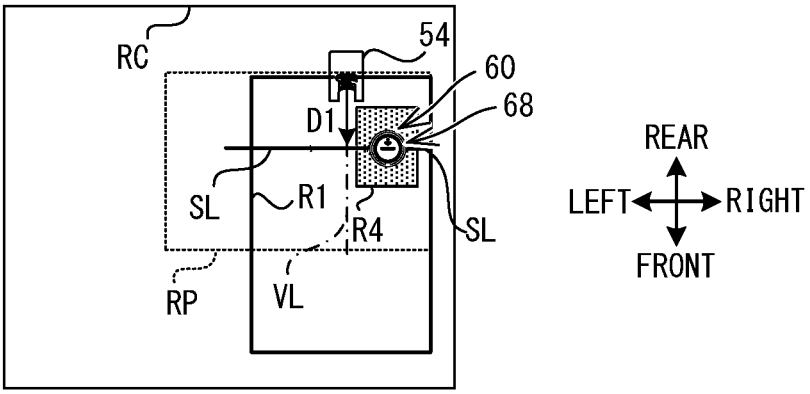
Figure 7B:
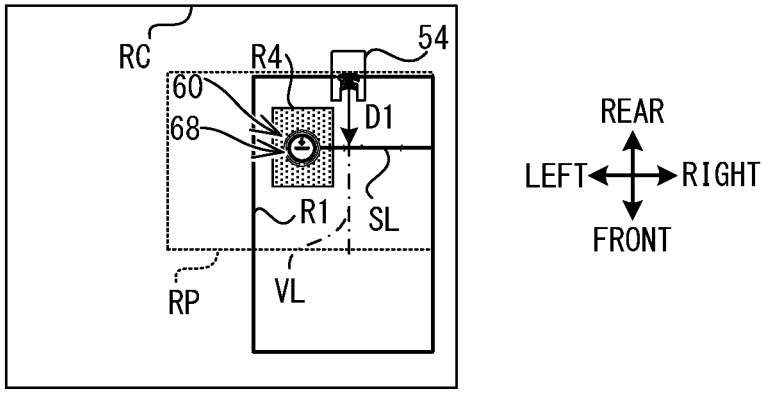
Figure 7C:
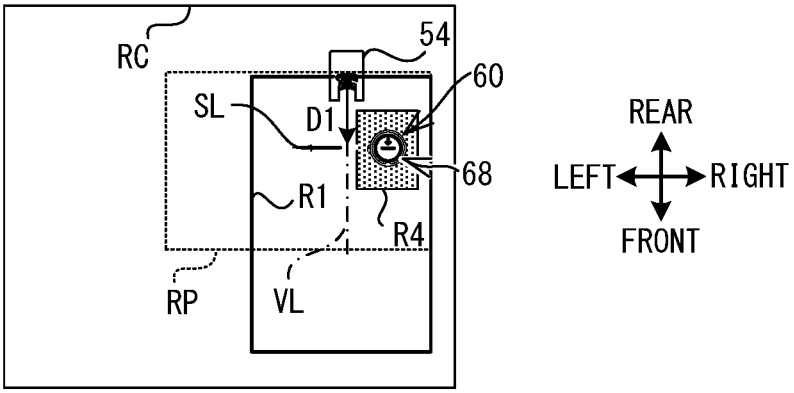
Figure 7D:
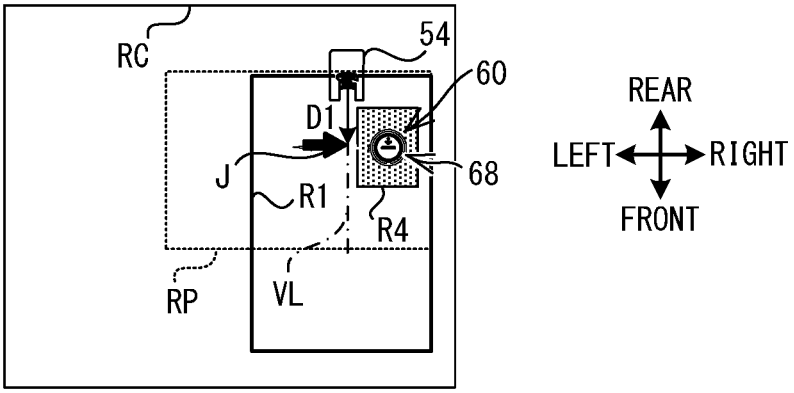
Figure 7E:
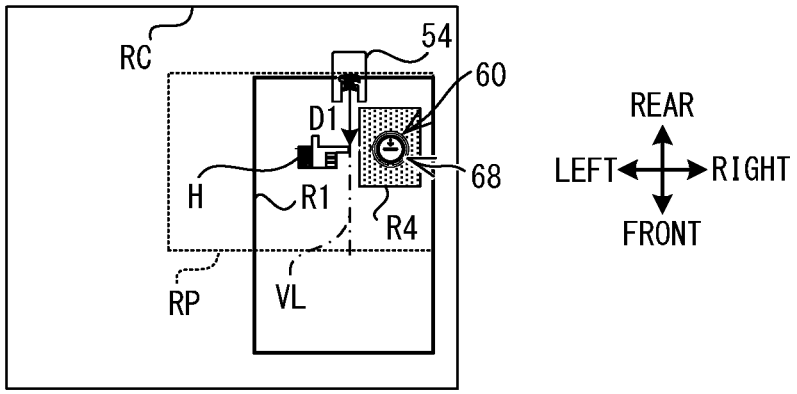

(C-3) The graphic in the projection image included as the graphic indicating the position of the marker detected by the sewing machine may be changed as appropriate. When the graphic is the line segment, an extending range of the line segment may be changed as appropriate. As shown in FIG. 7A, in the above-described embodiment, in place of the line segment SL shown in FIG. 6H, the processor 80 may also project the line segment SL extending to the opposite side (the right side of the marker 68) of the virtual line VL with respect to the projection position. In the above-described embodiment, when the projection position has been identified further to the left than the virtual line VL, as shown in FIG. 7B, the processor 80 may project the line segment SL extending further to the right than the marker 68, in the left-right direction (an orthogonal direction orthogonal to the conveyance direction on the upper surface of the bed portion 2). In other words, the processor 80 may change a setting method of an extending range of the graphic and an orientation of the graphic, in accordance with a relative position of the identified projection position and the virtual line VL (the needle drop position). As shown in FIG. 7C, the processor 80 may project the line segment SL that is separated from the virtual line VL, as the projection image, onto a position indicating the projection position. The processor 80 may indicate the position of the marker detected by the sewing machine 1 using the projection image that includes a graphic such as an arrow mark, a triangular shape, a trapezoid, or the like, as exemplified by a graphic J in FIG. 7D, or using the projection image including a pattern such as that of a graphic H exemplified in FIG. 7E. The graphic J is an arrow-shaped graphic and the right end of the graphic J indicates the projection position on the virtual line VL. The graphic H is a pattern representing a finger pointing at the projection position on the virtual line VL detected by the sewing machine 1. As with the graphic H, a center, in the conveyance direction, of the graphic indicating the projection position need not necessarily be the projection position. In addition to the graphic indicating the projection position, the processor 80 may include, in the projection image, a graphic or the like representing the virtual line VL.

(C-4) The processor 80 may cause the image capture portion to perform the image capture during a period in which the sewing object is being conveyed, during the conveyance period. A method of identifying a period, during the conveyance period, in which the sewing object is not being conveyed may be changed as appropriate. The sewing condition instructed by the marker may be changed as appropriate. Depending on processing corresponding to the sewing condition instructed by the marker, the processor 80 may change the processing performed by the processor 80 as appropriate. For example, when the marker is a marker instructing the sewing speed to be reduced by a predetermined amount, the processor 80 may calculate a distance, in the conveyance direction, from the marker position identified from the captured image to the position below the needle bar 51 (the needle drop position), and the processor 80 may reduce the sewing speed by the predetermined amount when the sewing object has been conveyed by the calculated distance. In the main processing, the processor 80 may cause the sewing speed to be constant, and may omit the processing at step S16, step S18, and step S19, for example, and may perform the processing at step S17 subsequent to the processing at step S15. When the marker is a marker instructing the stopping of the sewing, at step S15, the processor 80 may determine whether or not the distance calculated at step S11 is zero, and may stop the sewing when the distance is zero (step S28). The processing from step S24 to step S27 may be omitted as appropriate. The first distance D1 and the second distance D2 may be changed as appropriate. The processor 80 may change the sewing speed in three or more stages in accordance with the distance calculated at step S11.

(C-5) The processor 80 need not necessarily change the detection range after setting the first range R1, which is part of the captured image, as the detection range at the start of the sewing. The processor 80 may set the second range R2 as the detection range at the start of the sewing. After the marker has been identified on the basis of the detection range in the single captured image (yes at step S8, step S10), when the processor 80 cannot identify the marker from the detection range in the captured image by the subsequent image capture (no at step S8, yes at step S12), the processor 80 may set the first range R1 as the detection range (step S13). After setting the third range R3 as the detection range by the processing at step S13, the processor 80 need not necessarily perform the new image capture, and may perform processing to identify the marker 68 from the third range R3 in the captured image in which the marker 68 has not been identified.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a bed portion;

a conveyance portion including a feed dog, the conveyance portion being configured to convey a sewing object placed on the bed portion in a conveyance direction, using the feed dog;

a sewing portion including a needle bar, the sewing portion being configured to form stitches in the sewing object conveyed by the conveyance portion, by causing a sewing needle mounted on the needle bar to move up and down;

an image capture portion configured to perform image capture of an image capture range including below the needle bar;

a projector configured to project a projection image toward the bed portion;

a processor configured to control the conveyance portion, the sewing portion, the image capture portion, and the projector; and a memory configured to store marker information and computer-readable instructions that, when executed by the processor, instruct the processor to perform processes comprising:

causing the image capture portion to perform the image capture at a predetermined timing, during a conveyance period in which the conveyance portion is being driven;

identifying the marker in a captured image obtained by the image capture, using the marker information stored in the memory;

identifying a projection position corresponding to the identified marker, when the marker is identified; and causing the projector to project the projection image indicating the identified projection position, while following a movement of the marker on the sewing object being conveyed.

2. The sewing machine according to claim 1, wherein the causing the image capture portion to perform the image capture includes causing the image capture portion to perform the image capture a plurality of times during the conveyance period, the identifying the projection position includes identifying the projection position on the basis of the captured image each time the image capture is performed, and the causing the projector to project the projection image includes causing the projector to project the projection image while following the movement of the marker on the sewing object, by causing the projector to project the projection image indicating the identified projection position.

3. The sewing machine according to claim 1, wherein the identifying the projection position includes identifying, as the projection position, a position closer, by a predetermined amount, to the needle bar than a marker position, the marker position being a position, on the sewing object, of the marker identified on the basis of the captured image.

4. The sewing machine according to claim 3, wherein the computer-readable instructions further instruct the processor to perform a process comprising:

acquiring a sewing speed, and the identifying the projection position includes setting the predetermined amount to be larger the faster the acquired sewing speed, compared to when the sewing speed is slower, and identifying the projection position closer to the needle bar, by the set predetermined amount, than the marker position.

5. The sewing machine according to claim 1, wherein the causing the image capture portion to perform the image capture includes causing the image capture portion to perform the image capture while the sewing object is not being conveyed, during the conveyance period.

6. The sewing machine according to claim 1, wherein the computer-readable instructions further instruct the processor to perform processes comprising:

calculating a distance in the conveyance direction from a marker position to below the needle bar, the marker position being a position, on the sewing object, of the marker identified on the basis of the captured image, and stopping sewing by the conveyance portion and the sewing portion in a situation where the sewing object is conveyed by the calculated distance from the marker position.

7. The sewing machine according to claim 6, wherein the computer-readable instructions further instruct the processor to perform a process comprising:

stopping the sewing by the conveyance portion and the sewing portion in a situation where the calculated distance is a first distance.

8. The sewing machine according to claim 7, wherein the computer-readable instructions further instruct the processor to perform a process comprising:

causing a conveyance speed of the sewing object conveyed by the conveyance portion to be slower than a current speed, in a situation where the calculated distance is a second distance, the second distance being longer than the first distance.

9. The sewing machine according to claim 1, wherein at the projection position the projected image is a line segment extending in a direction orthogonal to the conveyance direction.

10. The sewing machine according to claim 9, wherein the causing the projector to project the projection image includes causing the projector to project the line segment, as the projection image, onto a virtual line extending to an upstream side in the conveyance direction from a position below the needle bar on the sewing object.

11. The sewing machine according to claim 1, wherein the causing the projector to project the projection image includes causing the projector to project the projection image onto the sewing object apart from onto the marker.

12. The sewing machine according to claim 1, wherein the computer-readable instructions further instruct the processor to perform a process comprising:

setting part of the captured image as a detection range, and the identifying the marker includes identifying the marker in the detection range, using the marker information stored in the memory.

13. The sewing machine according to claim 12, wherein the setting the detection range includes setting a first range, which is part of the captured image, as the detection range at a start of sewing, and when the marker is identified from the detection range of a single one of the captured images, setting, as the detection range of the captured image by a subsequent image capture, a range that is smaller than the first range and that includes the projection position identified from the single captured image.

14. The sewing machine according to claim 12, wherein the setting the detection range includes setting a first range, which is part of the captured image, as the detection range at a start of sewing, and when the marker is not identified from the first range, setting, as the detection range, a second range, the second range being smaller than the first range, the second range being on an upstream side, in the conveyance direction, in the captured image.

15. The sewing machine according to claim 12, wherein the setting the detection range includes, after the marker is identified on the basis of the detection range in a single one of the captured images, when the marker is not identified from the detection range in the captured image by a subsequent image capture, setting the detection range that includes a marker position and a range further to an upstream side, in the conveyance direction, than the detection range identified on the basis of the subsequent image capture, the marker position being a position on the sewing object of the marker identified on the basis of the single captured image.

* * * * *